US010207167B2

(12) United States Patent
Downing

(10) Patent No.: US 10,207,167 B2
(45) Date of Patent: Feb. 19, 2019

(54) SPORT TRAINING DEVICES

(71) Applicant: Rodney Downing, Hubertus, WI (US)

(72) Inventor: Rodney Downing, Hubertus, WI (US)

( * ) Notice: Subject to any disclaimer, the term of this patent is extended or adjusted under 35 U.S.C. 154(b) by 0 days.

(21) Appl. No.: 15/178,129

(22) Filed: Jun. 9, 2016

(65) Prior Publication Data

US 2016/0361616 A1 Dec. 15, 2016

Related U.S. Application Data

(60) Provisional application No. 62/173,479, filed on Jun. 10, 2015.

(51) Int. Cl.

| | |
|---|---|
| ***A63B 69/00*** | (2006.01) |
| ***A63B 67/00*** | (2006.01) |
| ***A63B 71/02*** | (2006.01) |
| ***A63B 63/00*** | (2006.01) |
| *A63B 61/00* | (2006.01) |

(52) U.S. Cl.

CPC ..... *A63B 69/0075* (2013.01); *A63B 63/00* (2013.01); *A63B 69/0095* (2013.01); *A63B 71/022* (2013.01); *A63B 61/006* (2013.01); *A63B 2210/50* (2013.01); *A63B 2225/093* (2013.01)

(58) Field of Classification Search

CPC . A63B 69/0075; A63B 63/00; A63B 69/0095; A63B 71/022; A63B 61/006; A63B 2210/50

USPC ..... 473/459, 449, 422, 462, 473, 450, 458, 473/418, 430; 124/51.1, 54

See application file for complete search history.

(56) References Cited

U.S. PATENT DOCUMENTS

| | | | | |
|---|---|---|---|---|
| 3,897,950 A | | 8/1975 | Keller | |
| 4,561,661 A | * | 12/1985 | Walker | A63B 69/0091 473/423 |
| 4,798,390 A | | 1/1989 | Dooley | |
| 4,881,742 A | | 11/1989 | Hargreave | |
| 4,887,821 A | * | 12/1989 | Greene | A63B 69/0075 473/459 |
| 4,940,150 A | | 7/1990 | Spengler | |
| 5,238,251 A | * | 8/1993 | Staka | A63B 69/0095 473/429 |
| 5,520,397 A | | 5/1996 | Thompson | |
| 5,660,395 A | | 8/1997 | Marshall | |

(Continued)

FOREIGN PATENT DOCUMENTS

| | | | | |
|---|---|---|---|---|
| DE | 2807743 A1 | * | 9/1979 | A63B 69/0075 |
| DE | 3634308 A1 | * | 4/1988 | A63B 69/0075 |

(Continued)

OTHER PUBLICATIONS

RMS 26 Soft-Grip Folding GRABBER Reacher With Ergonomic Handle.*
acuspike.com, last accessed Jun. 1, 2016.

*Primary Examiner* — Mitra Aryanpour
(74) *Attorney, Agent, or Firm* — Andrus Intellectual Property Law, LLP

(57) ABSTRACT

A sport training device for players practicing with balls that includes a support arm assembly having an arm post, a pivot assembly coupled to the arm post and comprising a claw assembly that supports a ball, and a clamp coupled to the arm post. The claw assembly is movable to a raised position, and the clamp is configured to engage the pivot assembly when the claw assembly moves to the raised position.

20 Claims, 6 Drawing Sheets

(56) References Cited

U.S. PATENT DOCUMENTS

| | | | | |
|---|---|---|---|---|
| 5,755,631 | A * | 5/1998 | Paschka | A63B 69/0095 473/424 |
| 7,041,016 | B1 | 5/2006 | Omtvedt | |
| 7,445,568 | B1 | 11/2008 | Steffensmeier | |
| 7,824,282 | B2 | 11/2010 | Wycoff | |
| 7,998,003 | B2 | 8/2011 | Orr | |
| 8,371,964 | B2 | 2/2013 | Jones et al. | |
| 8,900,075 | B2 * | 12/2014 | Gu | A63B 69/0002 473/422 |

FOREIGN PATENT DOCUMENTS

| | | | | |
|---|---|---|---|---|
| FR | 2668071 | A1 * | 4/1992 | A63B 69/0075 |
| SU | 1000038 | A * | 2/1983 | A63B 69/0075 |

* cited by examiner

SPORT TRAINING DEVICES

CROSS-REFERENCE TO RELATED APPLICATION

The present application is based on and claims priority to U.S. Provisional Patent Application Ser. No. 62/173,479 filed Jun. 10, 2015, the disclosure of which is incorporated herein by reference.

FIELD

The present disclosure relates generally to sport training devices, more specifically to volleyball training devices to be used by players to practice various skills including passing, setting, and hitting.

BACKGROUND

Participation in team sports is common at all ages and skill levels throughout the world. Many players who participate in these team sports practice skills to remain competitive with other players and/or teams. Volleyball in particular is becoming increasingly competitive and popular at all age levels (e.g. grade school, high school, and college).

During a volleyball game, a player performs numerous activities or skills such as serving, hitting, setting, and/or passing. The player repetitively practices these skills before the game to perfect the skills. The player can utilize different devices that assist in practicing these skills. These devices increase the number of times a player "practices" the skill and/or reduces the number of player and/or coaches required to practice the skills.

SUMMARY

This Summary is provided to introduce a selection of concepts that are further described herein below in the Detailed Description of the Drawings. This Summary is not intended to identify key or essential features of the claimed subject matter, nor is it intended to be used as an aid in limiting the scope of the claimed subject matter.

The present disclosure relates to a training device for players practicing with balls that includes a support arm assembly having an arm post, a pivot assembly coupled to the arm post and comprising a claw assembly that supports a ball, and a clamp coupled to the arm post. The claw assembly is movable to a raised position and the clamp is configured to engage the pivot assembly when the claw assembly moves to the raised position.

In certain examples, the volleyball training device for players practicing with volleyballs includes a support frame having an upper opening configured to receive volleyballs, a ball collector having a collector webbing configured to receive and collect volleyballs received through the upper opening, a collector basket mounted to the support frame and positioned to receive the volleyballs from the collector webbing, a support arm assembly pivotally coupled to the support frame and having a vertically adjustable arm post, and a pivot arm coupled to the arm post. The pivot arm is moveable between a raised position and a lowered position, and the pivot arm including a first end and a second end opposite the first end such that the pivot arm is coupled to the arm post at a fulcrum point positioned between the first end and the second end. The pivot arm is movable between the raised position and the lowered position about the fulcrum point. The volleyball training device also includes a counterweight positioned on the first end of the pivot arm to bias the pivot arm into the raised position, a claw assembly mounted to the second end of the pivot arm to support one of the volleyballs, and a clamp coupled to the arm post. The claw assembly includes a pair of claw members to receive and support one of the volleyballs. The clamp has a first end coupled to the arm post and a second end configured to receive and retain the pivot arm when the pivot arm is in the raised position.

Various other features, objects and advantages of the invention will be made apparent from the following description taken together with the drawings.

BRIEF DESCRIPTION OF THE DRAWINGS

Examples of the present disclosure are described with reference to the following drawing FIGURES. The same numbers are used throughout the FIGURES to reference like features and components.

DETAILED DESCRIPTION

In the present description, certain terms have been used for brevity, clearness, and understanding. No unnecessary limitations are to be implied here from beyond the requirements of the prior art because such terms are used for descriptive purposes only and are intended to be broadly construed. The different systems and methods described herein may be used alone or in combination with other systems and methods. Various equivalents, alternatives, and modifications are possible within the scope of the amended claims.

Through research and experimentation the present inventor has discovered a sport training device for practicing volleyball that allows a player to quickly position a ball at a player-specified height for practicing skills (e.g. hitting, tipping, setting, passing, tossing, accuracy). The training device allows the player to practice multiple skills at a home and/or in a gym with limited or no assistance from other players and/or coaches. The training device is light, portable, collapsible, and it can be used by players of any skill level. The training device can take a variety of orientations and include a variety of components discussed herein. The training device prevents injury to the player by reducing the stress put on the hands and/or arms.

Figure 1:
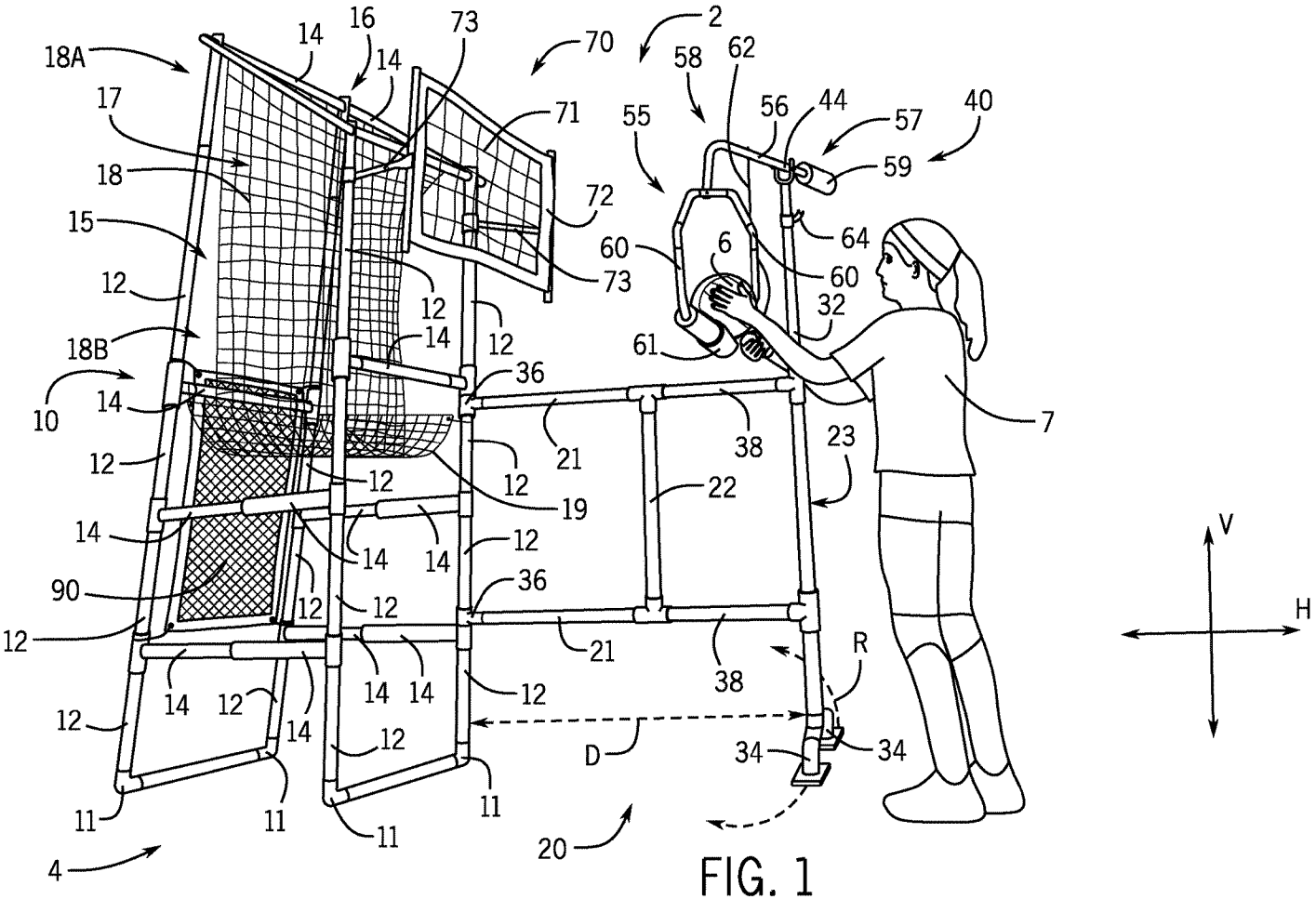
FIG. 1 is an example of the sport training device with a net and a pivot assembly having a claw assembly in a lowered position.
Figure 2:
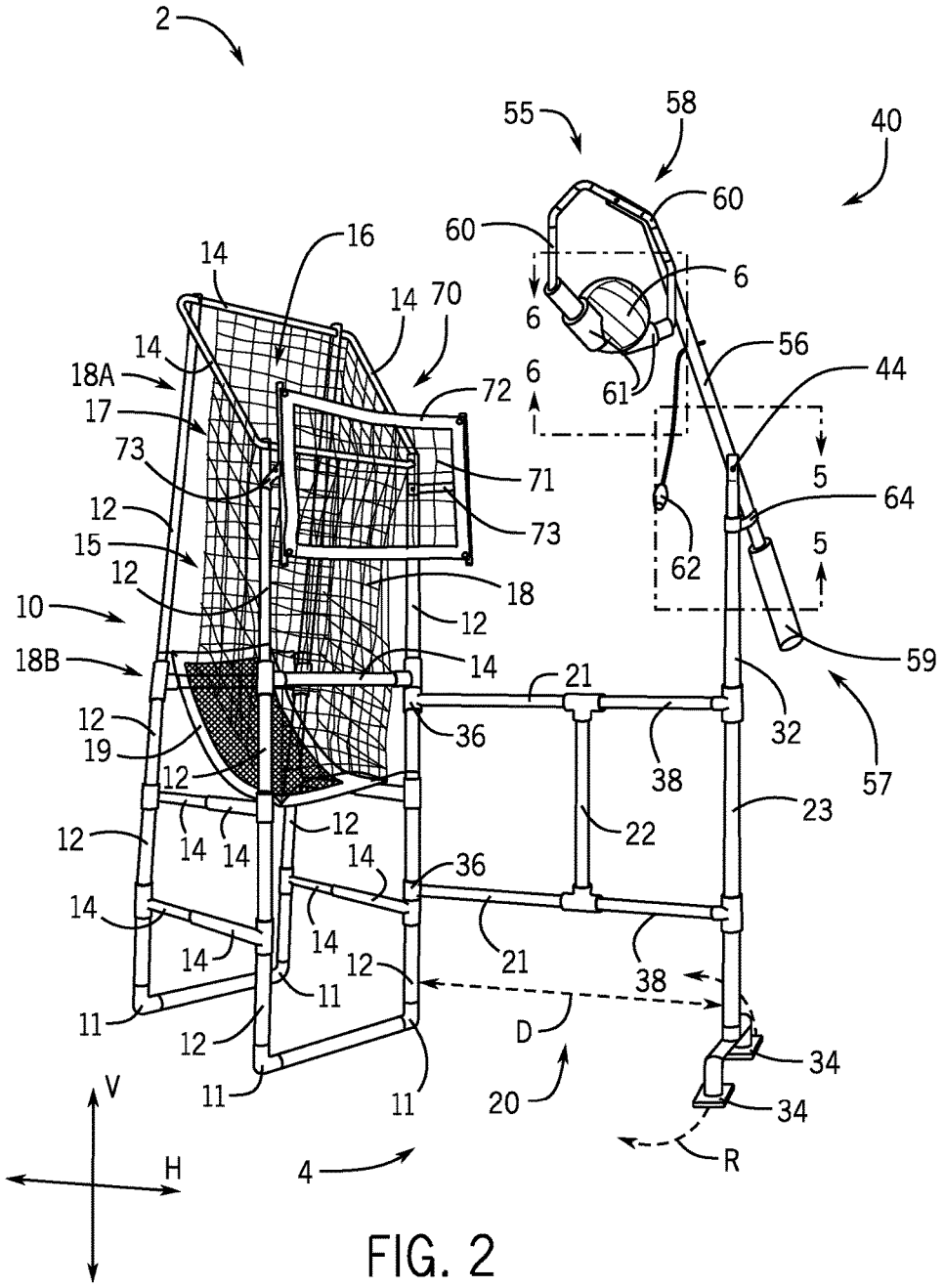
FIG. 2 is the example sport training device in FIG. 1 with the net and the pivot assembly having the claw assembly in a raised position.
Figure 3:
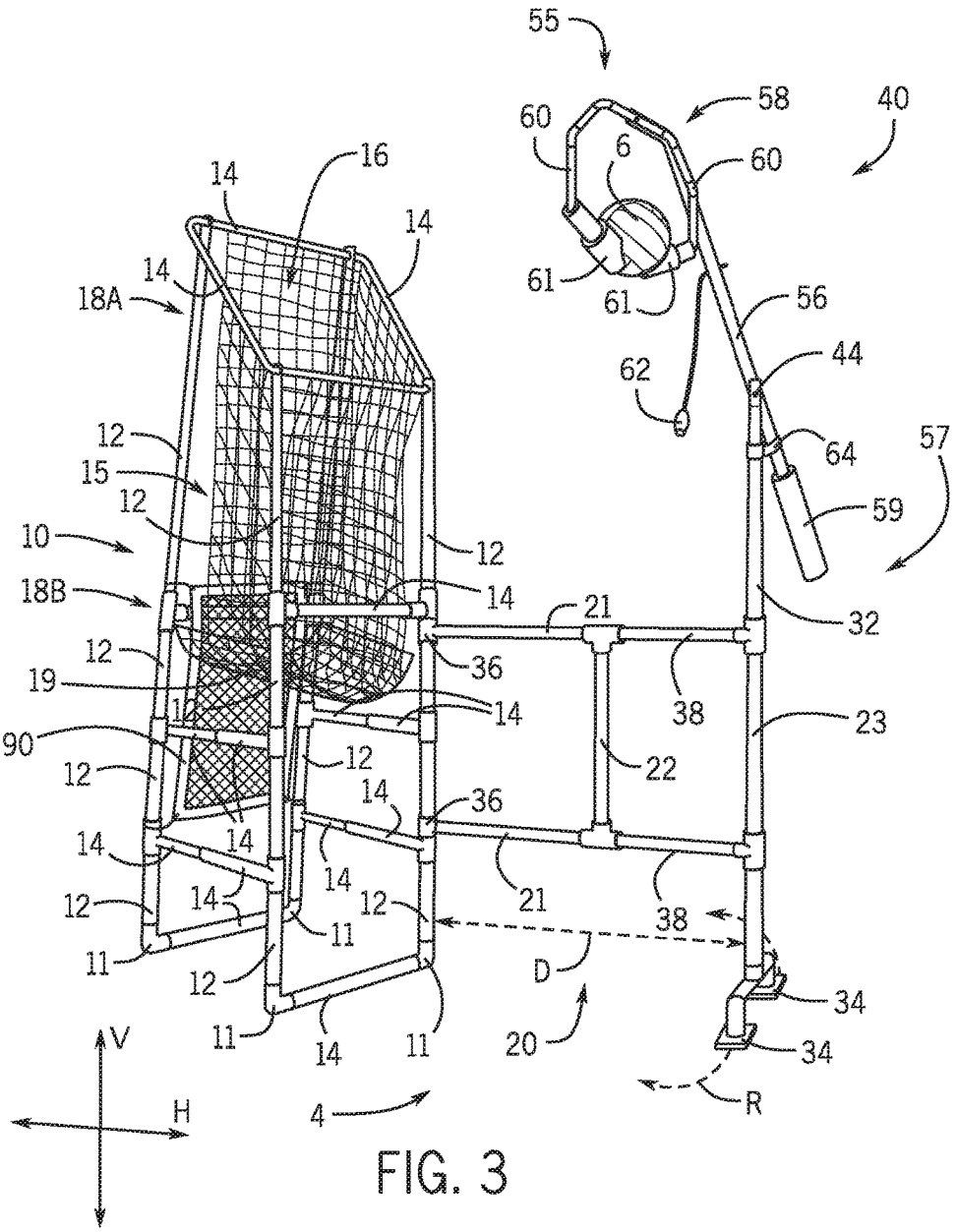
FIG. 3 is the example sport training device in FIG. 1 with the pivot assembly having the claw assembly in the raised position.

Referring to FIGS. 1-3, an example training device 2 includes a frame 10, a ball collector 17, a support arm assembly 20, and a pivot assembly 40. The frame 10 includes a plurality of bases 11, a plurality of vertical supports 12, and a plurality of lateral supports 14. The frame 10 defines an interior space 15 and an upper opening 16.

The bases 11 are configured to support the frame 10 and contact a support surface 4, such as horizontal gym floor. The bases 11 are coupled to the plurality of vertical supports 12 and/or the plurality of lateral supports 14. The vertical supports 12 extend generally upwardly in the vertical direction V from the base 11. The vertical supports 12 are coupled to the base 11 and/or the lateral supports 14. The vertical supports 12 are adjustable such that the height of the vertical supports 12 and/or the height of the frame 10 can be adjusted upwardly or downwardly in the vertical direction V. In some examples, the length of the vertical supports 12 changes by adding or removing sections of the vertical supports 12. In other examples, the vertical supports 12 include adjustable or extendable sections (not shown) that are configured to extend or retract to change the length of the vertical supports 12. The lateral supports 14 are coupled to the bases 11 and/or the vertical supports 12 and are configured to increase the stability of the frame 10. The lateral supports 14 prevent balls 6 and/or players 7 from entering the interior space 15 defined by the frame 10.

The bases 11, vertical supports 12, and/or lateral supports 14 create a lattice structure that extends generally upwardly in a vertical direction V from the support surface 4. In certain examples, the frame 10 is trapezoidal. The shape and size of the frame 10 is merely exemplary and can vary from that which is shown. The base 11, vertical supports 12, and lateral supports 14 can be constructed out of any suitable material including wood, plastic, metal, polyvinyl chloride (PVC), and/or the like. In certain examples, the base 11, vertical supports 12, and lateral supports 14 constructed of PVC components (e.g. tubes, elbows, t-fittings) which are removably or permanently coupled together by any suitable connector means including adhesive, screws, nuts and bolts, spring pin tubes, friction joints, compression joints, screw threads, pivot connectors, hinges, and/or the like.

The ball collector 17 is configured to catch and collect balls 6 used by the player 7. The ball collector 17 includes a collector webbing 18 extending between an upper end 18A and lower end 18B. The collector webbing 18 is configured to receive balls 6 entering the upper opening 16 defined by the frame 10 and direct the balls 6 downwardly in the vertical direction V to the collector basket 19. The upper end 18A of the collector webbing 18 is coupled to the lateral supports 14 and/or the vertical supports 12 of the frame 10 that define the upper opening 16. The lower end 18B of the collector webbing 18 is positioned in the interior space 15 defined by the frame 10. The ball collector 17 includes a collector basket 19 positioned in interior space 15 defined by the frame 10 and near the lower end 18B of the collector webbing 18. The collector basket 19 is coupled to the vertical supports 12 and/or the lateral supports 14. The collector basket 19 vertically supports the weight of a plurality of balls 6 such that the player 7 can retrieve the balls 6 supported by the collector basket 19. In operation, balls 6 enter the upper opening 16 of the frame and are directed downwardly in the vertical direction V by the collector webbing 18 toward the lower end 18B of the collector webbing 18. The balls 6 are then supported by the collector basket 19 until the player retrieves the balls from the ball collector 17. The ball collector 17 is made any suitable material including but not limited to nylon nets, fabric mesh, ropes, and elastic strands. The collector webbing 18 and/or the collector basket 19 are removably connected to the supports 12, 14 and are flexible to accommodate the weight and force of several balls entering the collector webbing 18.

The support arm assembly 20 is connected to the frame 10 such that the player can rotate the support arm assembly 20 relative to the frame 10. In some examples, the support arm assembly 20 can be rotated out of the way of the frame 10 when the skill being practiced by the player 7 does not require the support arm assembly 20.

The support arm assembly 20 extends outwardly from the frame 10 in a horizontal direction H. The support arm assembly 20 includes at least one lateral arm 21 that pivotably couples the support arm assembly 20 to the frame 10, at least one vertical support 22, and at least one arm post 23. The lateral arms 21 are coupled to the frame 10 with pivot connections 36 that allow the support arm assembly 20 to pivot around the frame 10 along radial path R. The lateral arms 21 include adjustable sections 38 that allow the player 7 the change a distance D between the arm post 23 and the frame 10. In one example, the adjustment sections 38 are push-button connector sections that retract into adjacent sections of the lateral arms 21. Other suitable adjustable section and/or connectors can be used including but not limited to compression joints, screw threads, snap brackets, and/or the like. The lateral arms 21 and the vertical supports 22 increase the stability of the support arm assembly 20. In certain examples, the lateral arms 21 are pivotally coupled to the frame 10 such that the arm post 23 of the support arm assembly 20 can move to a plurality of positions along the radial path R.

The arm post 23 is adjustable such that the height of the pivot assembly 40 (described further herein) can increase or decrease to the height and/or jumping height of the player 7. The arm post 23 includes an adjustment section 32 and a pair of post bases 34. The adjustment section 32 is configured such that the height of the pivot assembly 40 in the vertical direction V can be changed easily by the player 7. In one example, the adjustment section 32 is a push-button connector section that retracts into adjacent sections of the arm post 23. Other suitable adjustment sections and/or connectors can be used including but not limited to compression joints, screw threads, snap brackets, and/or the like. In certain examples, the arm post 23 can include a lock (not shown) that is configured to lock the arm post 23 at a specific height. The post bases 34 engage the support surface 4 and support the arm post 23. Any number of post bases 34 can be used. The post bases 34 can be shoes, wheels, castors, low friction pads, and/or the like.

Figure 5:
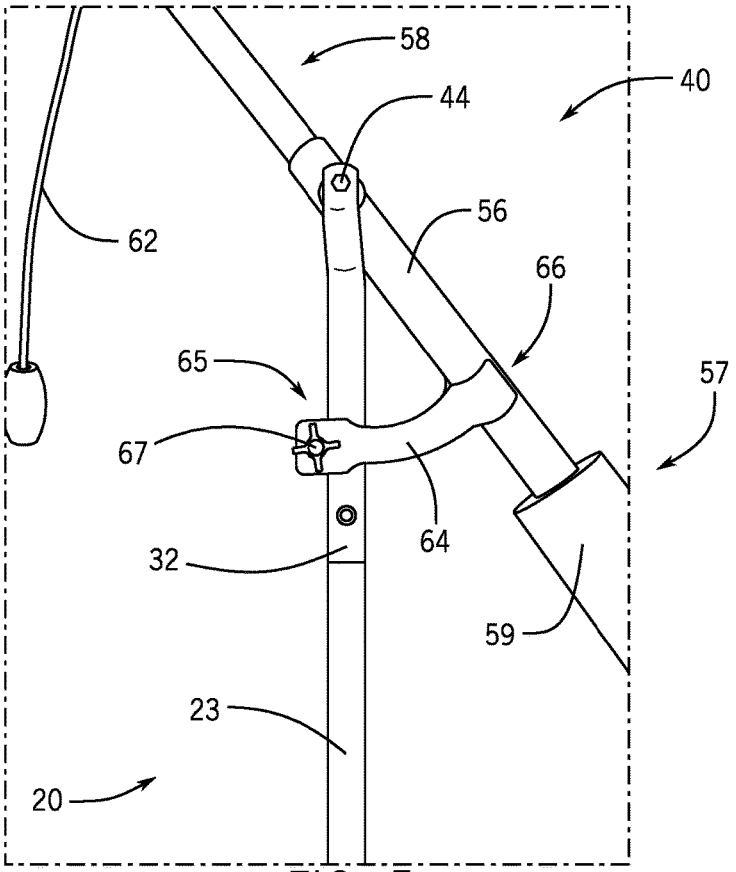
FIG. 5 is an example the example clamp shown in FIG. 2 along line 5-5.
Figure 6:
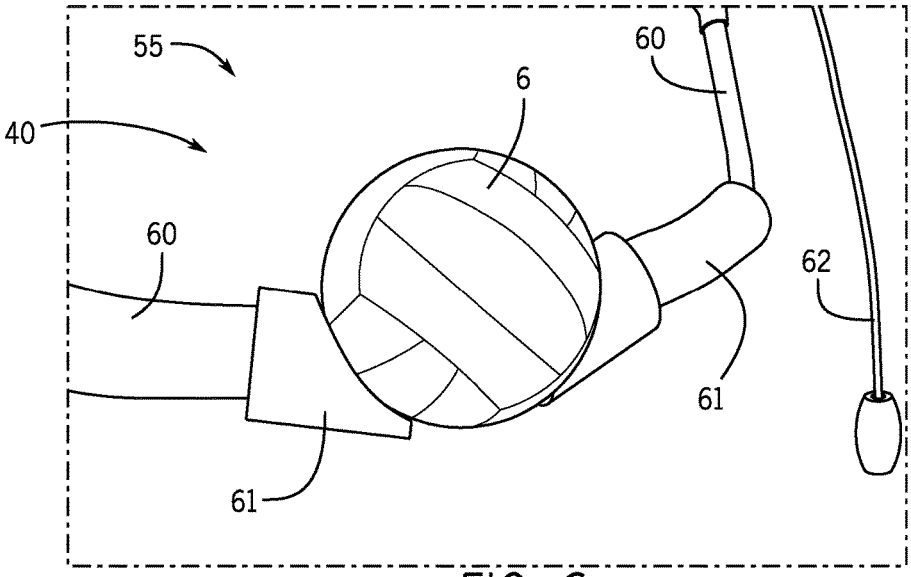
FIG. 6 is an example of the claw assembly shown in FIG. 2 along line 6-6.

The pivot assembly 40 is pivotally and/or rotatably coupled to the arm post 23 of the support arm assembly 20 at a fulcrum point 44. The pivot assembly 40 includes a pivot arm 56, a handle 59, a strap 62 (see also FIGS. 5-6), a clamp 64 (see also FIG. 5), and a claw assembly 55 having pair of claw members 60 (see also FIG. 6).

The pivot arm 56 has a first end 57 and a second end 58 opposite the first end 57, and the pivot arm 56 is coupled to the fulcrum point 44 between the first end 57 and the second end 58. The handle 59 is coupled to the first end 57 and the claw assembly 55 is coupled to the second end 58. The pivot arm 56 is configured to pivot about the fulcrum point 44 such that the claw assembly 55 moves between a lowered position (see FIG. 1) and a raised position (see FIGS. 2-3) as the handle 59 is moved upwardly and downwardly in the vertical direction V, respectively, by the player 7.

The claw members 60 are configured to receive and support a ball 6. Each claw members 60 include a claw support 61 configured to contact the ball 6 such that the ball 6 is supported when the claw assembly 55 (see FIG. 6) is in the lowered position (see FIG. 1) and the raised position (see FIGS. 2-3). In certain examples, the claw members 60 can pivot relative to each other wherein the claw members 60 are biased toward each other such that the claw members 60 apply a compression force to the ball 6 supported by the claw supports 61.

The handle 59 can be grasped by the player 7. In some examples, the handle 59 is counterweighted of the same weight as the claw members 60. In other examples, the handle 59 is weighted such that the entire pivot arm 56, including the claw assembly 55 on second end, is biased to the raised position (see FIG. 2). In another example, the handle 59 is hollow and receives a supply of sand to create the required weight to bias the pivot arm 56 into the raised position. Other materials could be used to create the counterweight in the handle 59. In the example depicted, a resilient pad is included on the handle 59. Both the claw supports 61 and/or the padding on the handle 59 are made of soft material such as foam, cloth, and/or the like. The claw assembly 55 can be detached from the training device 2.

The strap 62 is coupled to the pivot arm 56 between the fulcrum point 44 and the second end 58 of the pivot arm 56. The strap 62 extends downwardly in the vertical direction V due to gravity. The strap 62 is configured such that the player 7 can grasp the strap to move the claw assembly 55 from the raised position (see FIGS. 2-3) to the lowered position (see FIG. 1). When the strap 62 is released, the counterweight in the first end of the pivot arm 56 automatically returns the pivot arm 56 to the raised position of FIGS. 2-3.

The clamp 64 is coupled to the arm post 23 and configured to removably couple with the pivot arm 56 such that when the clamp 64 is coupled to the pivot arm 56, the claw assembly 55 is securely held in the raised position (see FIGS. 2-3). The clamp 64 includes a first end 65 and second end 66 opposite the first end 65. The first end 65 of the clamp 64 is coupled to the arm post 23 and/or adjustment section 32 (see FIG. 5). The first end 65 includes a clamping mechanism 67 that tightens and secures the first end 65 of the clamp 64 to the arm post 23. The clamping mechanism 67 can be loosened such that the first end 65 of the clamp 64 moves upwardly and/or downwardly to a player-specified position on the arm post 23. When the first end 65 of the clamp 64 is in the player-specified position, the clamping mechanism 67 is tightened. The clamping mechanism 67 is a threaded bolt and nut. The type of clamping mechanism 67 is merely exemplary and can vary from that which is shown.

The second end 66 of the clamp 64 is configured to engage the pivot arm 56 between the fulcrum point 44 and the first end 57 of the pivot arm 56. The second end 66 of the clamp 64 elastically deforms as the second end 66 of the clamp 64 engages the pivot arm 56. The player can disengage the pivot arm 56 from the clamp 64 by pulling on the strap 62 (described above) such that the claw assembly 55 moves to the lowered position (see FIG. 1). When the strap 62 is released, the weight of the counterweight in the first end of the pivot arm 56 returns the pivot arm 56 to raised position with enough force such that the second end 66 of the clamp receives and engages the pivot arm 56.

In one non-limiting operational example, the player 7 locates the clamp 64 along the arm post 23 and secures the clamp to the arm post 23 by tightening the clamping mechanism 67. With the claw assembly 55 in the lowered position (see FIG. 1), the player 7 places a ball 6 into engagement with the claw supports 61 of the claw members 60. The player 7 releases the handle 59 of the pivot arm 56 and the weight of the counterweight in the first end moves the claw assembly 55 with the ball 6 to the raised position (see FIG. 2) such that the second end 66 of the clamp 64 engages the pivot arm 56 (as described above). The player 7 practices an example skill by jumping and hitting the ball 6 out of engagement with the claw supports 61 and into the ball collector 17 (described above). To "reload" the claw members 60 with another ball 6, the player 7 pulls on the strap 62 which disengages the pivot arm 56 from the second end 66 of the clamp 64 such that the claw assembly 55 moves to the lowered position (see FIG. 1).

Figure 4:
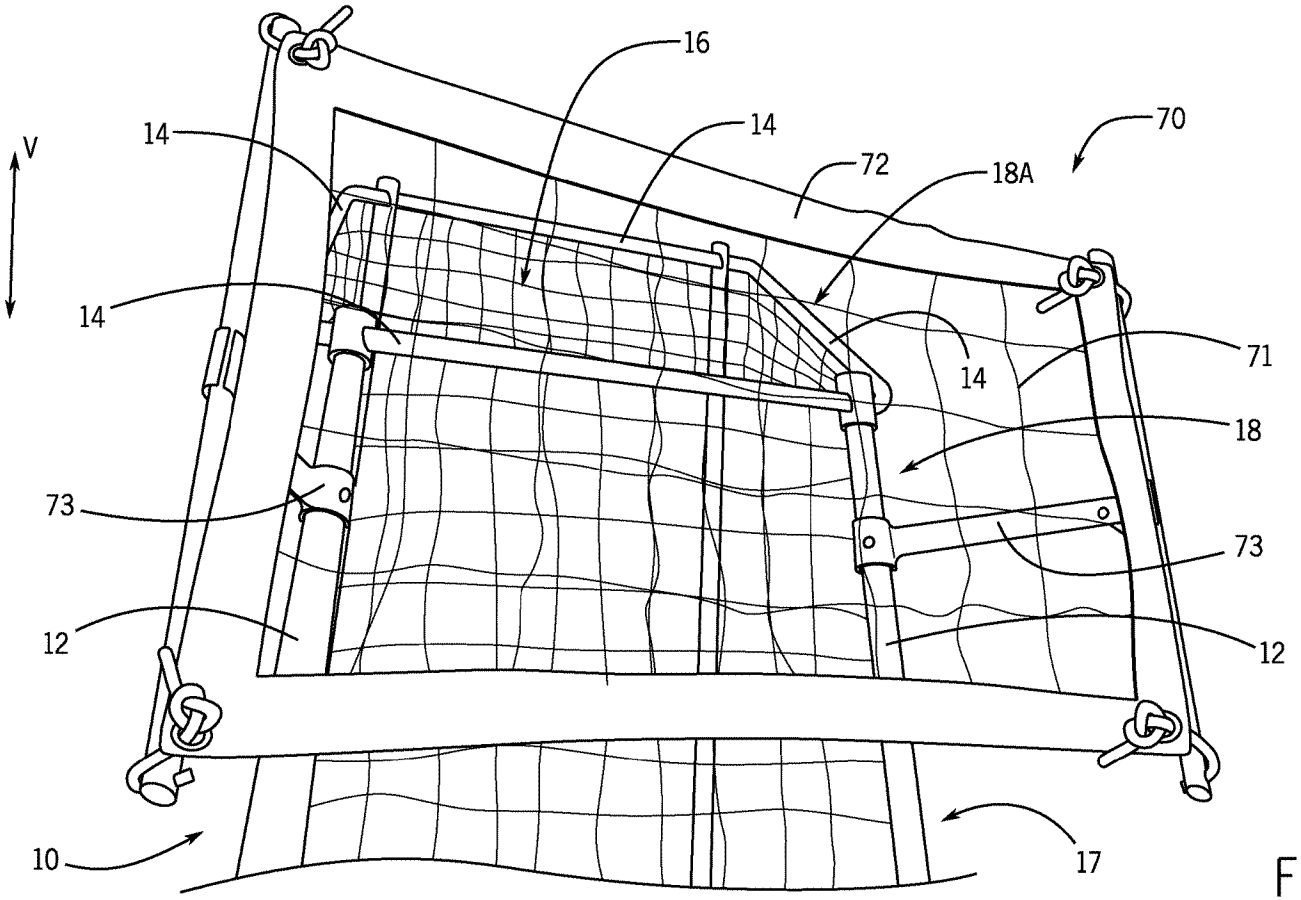
FIG. 4 is an example net.

The training device 2 is configured to be interchangeable and/or expandable with other accessories which can be coupled to the frame 10 and/or support arm assembly 20. In one example, a vertical jump trainer (not shown) is coupled to the support arm assembly 20. In another example, a net 70 is coupled to the frame 10 (see FIGS. 1-2 and 4). The net 70 is configured to imitate a game net used in a real game. The net 70 includes webbing 71 coupled to edge members 72 and supported by net standoffs 73 configured to pivotally couple to the edge members 72 and the vertical supports 12 and/or the lateral supports 14 of the frame 10 such that the player 7 can change the angle and/or height in the vertical direction V of the net 70. In another example, a backstop 90 is coupled to the frame 10 (see FIG. 1). The backstop 90 is coupled to the frame 10 such that player 7 can hit balls 6 at the backstop 90 which is configured to rebound or return the balls 6 to the player 7 to be hit again. The backstop 90 can also be configured to collect and/or support balls 6 that travel down through the ball collector 17. The backstop 90 is coupled to the frame 10 by bungle cords, rope, and/or the like.

Figure 7:
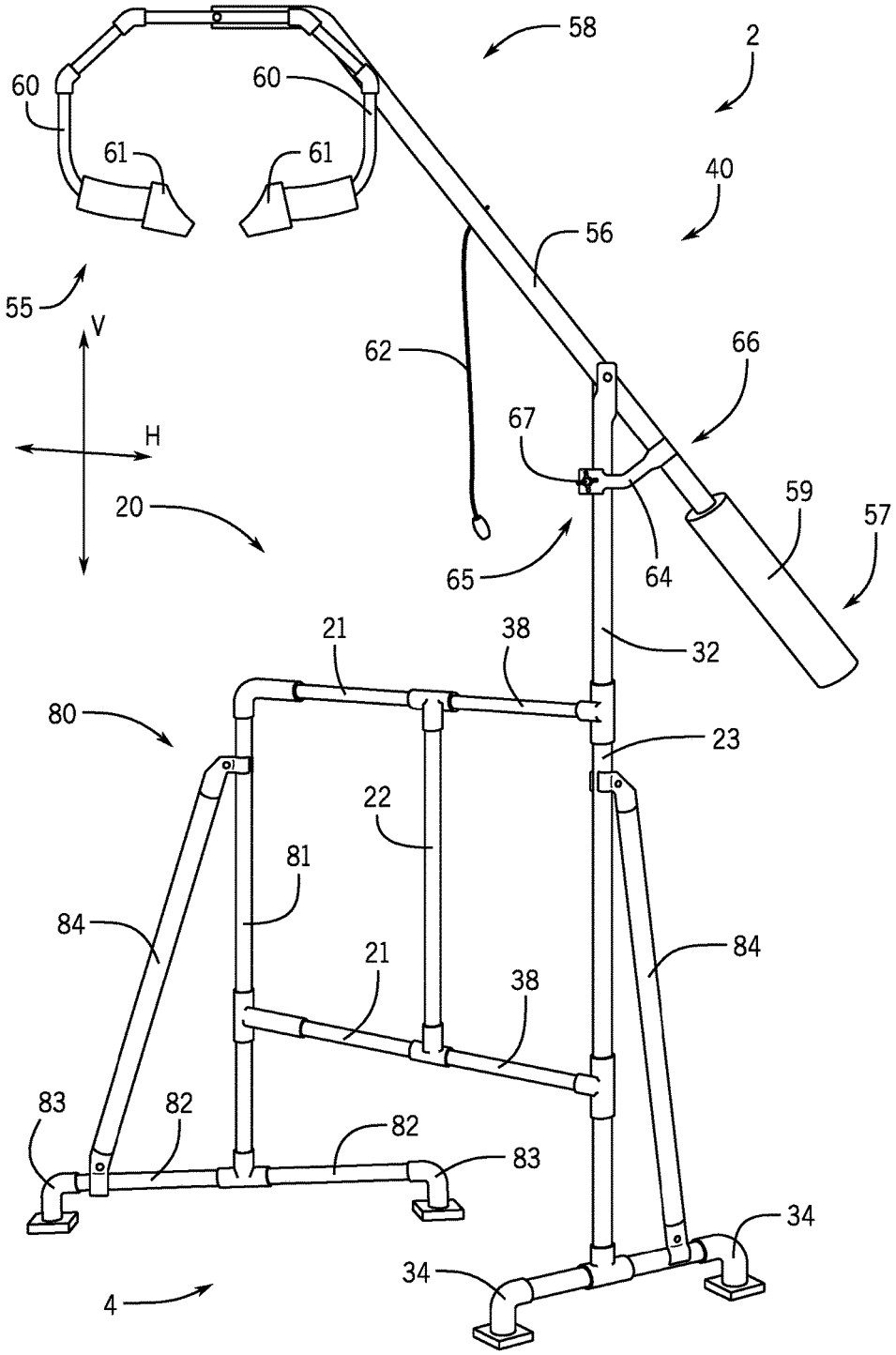
FIG. 7 is an example sport training device.

Referring to FIG. 7, another example of the training device 2 of the present disclosure is depicted. The training device 2 includes the support arm assembly 20 and pivot assembly 40 as described above, and in this example, the training device 2 is free-standing and is not coupled to the frame 10. Instead, the training device 2 includes a support member 80 opposite the arm post 23 of the support arm assembly 20. The support member 80 includes a vertical support 81, at least one lateral support 82 coupled to the vertical support 81, and at least one post base 83 coupled to the lateral supports 82 and configured to support the training device 2 on the support surface 4. The training device 2 also includes at least one angled support 84 coupled to the vertical support 81 and the lateral support 82 and configured to prevent swaying of the training device 2. The angled support 84 can also be coupled to the support arm assembly 20. Any number of post bases 34 can be used. The post bases 34 can be shoes, wheels, castors, low friction pads, and/or the like.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A training device for players practicing with a ball, the training device comprising:

a support arm assembly having an arm post;

a pivot assembly coupled to the arm post and comprising a pivot arm and a claw assembly, wherein the claw assembly is mounted to the pivot arm and configured to receive and support the ball, wherein the pivot arm is pivotally mounted to the arm post such that the claw assembly and the ball are movable into and between a lowered position and a raised position in which the ball and the claw assembly are located vertically above the lowered position; and a clamp having a first end movably coupled to the arm post such that the clamp is movable upwardly and downwardly along the arm post and a second end configured to receive and engage the pivot arm to hold the claw assembly and the ball in the raised position wherein the position of the first end of the clamp along the arm post sets the raised position and the pivot arm disengages from the clamp to permit the claw assembly and the ball to move to the lowered position.

2. The training device according to claim 1, wherein the second end of the clamp elastically deforms when the clamp receives and engages the pivot arm.

3. The training device according to claim 1, wherein the pivot arm has a first end and an opposite, second end, and wherein the pivot arm is pivotally mounted to the arm post at a fulcrum point positioned between the first end of the pivot arm and the second end of the pivot arm.

4. The training device according to claim 3, wherein the second end of the clamp holds the pivot arm between the fulcrum point and the first end of the pivot arm when the claw assembly is in the raised position.

5. A training device for players practicing with a ball, the training device comprising:

a support arm assembly having an arm post;

a pivot assembly coupled to the arm post and comprising a claw assembly that supports the ball, wherein the claw assembly is movable between a raised position and a lowered position; and a clamp movably coupled to the arm post such that the clamp is movable upwardly and downwardly along the arm post and configured to engage the pivot assembly when the claw assembly is in the raised position;

wherein the pivot assembly further comprises a pivot arm having a first end and a second end opposite the first end, wherein the pivot assembly is coupled to the arm post at a fulcrum point positioned between the first end of the pivot arm and the second end of the pivot arm;

wherein the second end of the clamp engages the pivot arm of the pivot assembly between the fulcrum point and the first end of the pivot arm to securely hold the claw assembly in the raised position; and wherein the first end of the pivot arm includes a counterweight to bias the claw assembly into the raised position.

6. The training device according to claim 5, wherein the pivot assembly further comprises a strap coupled to the pivot arm between the fulcrum point and the second end of the pivot arm.

7. The training device according to claim 5, wherein the claw assembly comprises a pair of claw members, and wherein the claw members are coupled to the second end of the pivot arm.

8. The training device according to claim 7, wherein each of the pair of claw members includes a claw support configured to support the ball when the claw assembly is in the raised position.

9. The training device according to claim 8, wherein the claw members pivot relative to each other.

10. The training device according to claim 9, wherein the claw members are biased toward each other such that the claw members apply a compression force to the ball.

11. The training device according to claim 5, wherein the arm post comprises an adjustment section configured to change the height of the pivot assembly in a vertical direction.

12. The training device according to claim 1, further comprising a frame coupled to the support arm assembly, and wherein the support arm assembly extends radially outwardly from the frame in a horizontal direction.

13. A training device for players practicing with a ball, the training device comprising:

a frame;

a support arm assembly having an arm post, wherein the support arm assembly extends radially outward from the frame in a horizontal direction and is pivotally coupled to the frame such that the arm post is movable along a radial path;

a pivot assembly coupled to the arm post and comprising a pivot arm and a claw assembly, wherein the claw assembly is mounted to the pivot arm and configured to receive and support the ball, wherein the pivot arm is pivotally mounted to the arm post such that the claw assembly and the ball are movable into and between a lowered position and a raised position in which the ball and the claw assembly are located vertically above the lowered position; and a clamp having a first end coupled to the arm post and a second end configured to receive and engage the pivot arm to hold the pivot arm in the raised position.

14. The training device according to claim 13, wherein the support arm assembly further comprises an adjustable section configured to change a distance between the arm post and the frame.

15. The training device according to claim 13, wherein the frame defines an upper opening configured to receive balls.

16. The training device according to claim 15, further comprising a net having net standoffs, and wherein the standoffs are configured to pivotally couple the net to the frame such that the net is vertically movable.

17. The training device according to claim 16, further comprising a ball collector configured to receive and collect balls received through the upper opening.

18. The training device according to claim 17, wherein the ball collector has a collector webbing having a first end, an opposing, second end, and a collector basket positioned adjacent to the second end of the collector webbing, and wherein the collector basket is configured to support a plurality of balls.

19. A volleyball training device for players practicing with volleyballs, the training device comprising:

a support frame having an upper opening configured to receive volleyballs;

a ball collector having a collector webbing configured to receive and collect volleyballs received through the upper opening;

a collector basket mounted to the support frame and positioned to receive the volleyballs from the collector webbing;

a support arm assembly pivotally coupled to the support frame, the support arm assembly having a vertically adjustable arm post;

a pivot arm coupled to the arm post, the pivot arm being moveable between a raised position and a lowered position, the pivot arm including a first end and a second end opposite the first end, wherein the pivot arm is coupled to the arm post at a fulcrum point positioned between the first end and the second end such that the pivot arm is movable between the raised position and the lowered position about the fulcrum point;

a counterweight positioned on the first end of the pivot arm to bias the pivot arm into the raised position;

a claw assembly mounted to the second end of the pivot arm to support one of the volleyballs, wherein the claw assembly includes a pair of claw members to receive and support one of the volleyballs; and a clamp coupled to the arm post, the clamp having a first end coupled to the arm post and a second end configured to receive and retain the pivot arm when the pivot arm is in the raised position.

20. The volleyball training device of claim 19, further comprising a strap coupled to the pivot arm between the fulcrum point and the second end of the pivot arm.

* * * * *